US008276358B2

(12) United States Patent
Hsu et al.

(10) Patent No.: US 8,276,358 B2
(45) Date of Patent: Oct. 2, 2012

(54) PROCESS OF MANUFACTURING ULTRA-SOFT YARN AND FABRIC THEREOF

(75) Inventors: Chih-Chang Hsu, Taipei (TW); Hsin-Chuan Chen, Taipei (TW); Chen-Chi Lee, Taipei (TW)

(73) Assignee: Ruentex Industries Limited, Taipei (TW)

( * ) Notice: Subject to any disclaimer, the term of this patent is extended or adjusted under 35 U.S.C. 154(b) by 325 days.

(21) Appl. No.: 12/645,293

(22) Filed: Dec. 22, 2009

(65) Prior Publication Data

US 2011/0146832 A1 Jun. 23, 2011

(51) Int. Cl.
*D02G 3/38* (2006.01)

(52) U.S. Cl. ..... 57/210; 57/3

(58) Field of Classification Search ..... 57/3, 210
See application file for complete search history.

(56) References Cited

U.S. PATENT DOCUMENTS

| | | | | |
|---|---|---|---|---|
| 3,577,873 | A | 5/1971 | Waters | |
| 3,691,750 | A | 9/1972 | Waters | |
| 3,831,369 | A * | 8/1974 | Northup et al. | 57/225 |
| 4,069,656 | A * | 1/1978 | Arai et al. | 57/6 |
| 4,244,173 | A * | 1/1981 | Lulay | 57/227 |
| 4,346,553 | A * | 8/1982 | Schwartz | 57/210 |
| 4,729,215 | A * | 3/1988 | Sato et al. | 57/210 |
| 4,840,021 | A * | 6/1989 | Guevel et al. | 57/210 |
| 5,572,860 | A * | 11/1996 | Mitsumoto et al. | 57/224 |
| 6,945,026 | B1 * | 9/2005 | Hanna | 57/3 |
| 2005/0142972 | A1 * | 6/2005 | Govindaswamy | 442/304 |
| 2008/0103001 | A1 * | 5/2008 | Lofgren et al. | 474/237 |

* cited by examiner

*Primary Examiner* — Shaun R Hurley

(74) *Attorney, Agent, or Firm* — Muncy, Geissler, Olds & Lowe, PLLC

(57) ABSTRACT

A process of manufacturing a ultra-soft yarn includes wrapping a roving material with a yarn by a low twist-multiplier of about 1~4, wherein the roving material is drawn at a draw ratio preferably between 1 and 10, wherein the ultra-soft yarn has a fluffy structure, which can provide better softness, draping property, and hand feel to users. Fabric including the ultra-soft yarn is also provided.

19 Claims, 1 Drawing Sheet

PROCESS OF MANUFACTURING ULTRA-SOFT YARN AND FABRIC THEREOF

BACKGROUND OF THE INVENTION

1. Field of the Invention

The present invention relates generally to a yarn. Particularly, the present invention relates to a ultra-soft yarn with a low twist multiplier to form a fluffy structure providing ultra-soft touch, and a fabric made of the yarn 2. Description of the Prior Art Compared to classical, spun cotton yarns and mixed yarns in which the core yarn is made of polyester and the effect yarn is made of cotton, synthetic yarns, especially the widely used polyester yarns can be advantageously made as continuous yarn with hardly any impurities and display a significantly increased strength. Synthetic yarns have however the drawback that they are less fluffy and thus exhibit a more wire-like character and are substantially harder in handle than cotton yarns or mixed yarns. Accordingly, various defects will be caused during actual application of the synthetic yarns.

As for mixed yarns disclosed in the specifications of U.S. Pat. No. 3,577,873 and U.S. Pat. No. 3,691,750, when at least two filamentary yarns differing in extensibility under stress are doubled, fed to a feed roller and twisted by a false twist element, the filamentary yarn having a lower extensibility occupies a core portion because of its reduced tendency to elongate, while the filamentary yarn having a higher extensibility is twisted to wrap the core portion helically because it is readily elongated. When this twisted state is thermally set and untwisting is thereafter effected, there is obtained a textured composite yarn having two layers, which yarn comprises a core portion mainly composed of the filamentary yarn having a lower extensibility and a wrapping portion composed of the filamentary yarn having a higher extensibility and helically wrapping the core portion in the twisted state.

Such finished yarn is ordinarily manufactured at a processing speed lower than 100 m/min. However, to obtain a finished yarn of this type for use in making high quality woven or knitted fabrics, the yarn must be carefully prepared at a processing speed as low as 60 m/min or less. However, production as such a low speed tends to be very inefficient, thus disadvantageously causing the resultant product to be commercially unprofitable.

In addition, the above-mentioned finished yarn is hardly dyed during manufacture process due to the different extensibility. Therefore, dying problem is also a serious drawback resulting in a lot of profit loss.

SUMMARY OF THE INVENTION

It is an object of the present invention to provide an ultra-soft yarn which has none of the above-mentioned defects of the conventional yarns. The yarn structure of the ultra-soft yarn including a core portion and a wrapping portion is permanently stabilized and the formation of neps and pills is effectively prevented.

The second object of the present invention is to provide an improved textured yarn which can be dyed after the core portion and the wrapping portion are spun together for a better color collocation.

It is a further object of the present invention to provide an improved process to make low shrinkage yarn which exhibits a sufficient ultimate tenacity while yet displaying a fluffy consistency and thus a soft feel as well as having superior sewing properties.

The present invention provides a process for manufacturing an ultra-soft yarn with fluffy structure. The process includes a step of spinning a roving material with a low twist-multiplier and wrapping with a yarn, wherein both of the roving material and the yarn are drawn at a draw ratio in a wrapping state for providing the ultra softy touch. In addition, the draw ratio is, but not limited to be, between 1 and 10 in order to prevent formation of pills.

Besides, the making-yarn process is under the condition that the spun yarn is spun with the roving material by a twist-multiplier about 1~4. Under such condition, the formation of neps can be effectively prevented. In order to obtain a yarn satisfying the second object, the micro twisted yarn can be dyed after the yarn is spun; meanwhile, the yarn and the roving material are spun together.

DETAILED DESCRIPTION OF THE PREFERRED EMBODIMENT

The present invention provides a soft yarn with a low twist multiplier to create a fluffy structure, which can adopt various spinning processes. The soft yarn with fluffy structure is made by spinning a roving material with a spun yarn by a twist-multiplier (T.M.) of about 1 to 4. Since the soft yarn has various micro structures providing the feeling of ultra softy touch to users, it also refers to "ultra-soft yarn" hereinafter. The spun yarn serving as the wrapping portion of the ultra-soft yarn provides major strength and wraps the slight twisted roving material evenly, wherein the roving material serves as the core portion of the ultra-soft yarn. Besides, since the twist-multiplier ranges between 1 and 4, the relatively low T.M. can effectively prevent the formation of neps and pills. The ultra-soft yarn can be manufactured in an appropriate yarn count (Ne). For example, the roving material has a yarn count of at least up Ne 5 to Ne 10, preferably to Ne 20, and more preferably to Ne 50. In addition, the spun yarn has a yarn count preferably between Ne 40 and Ne 300; however, in another embodiment, the spun yarn can be replaced with the filament which is between 100 Denier and 10 Denier.

Besides, since the present invention also provides fabric made of the above-mentioned yarn, the formation of neps and pills is effectively prevented. The ultra-soft yarn of the present invention can apply to any kind of woven or knitted fabrics. Thus, such fabric also provides better softness, draping property, and hand feel to users because of the ultra-soft yarn.

Figure 1:
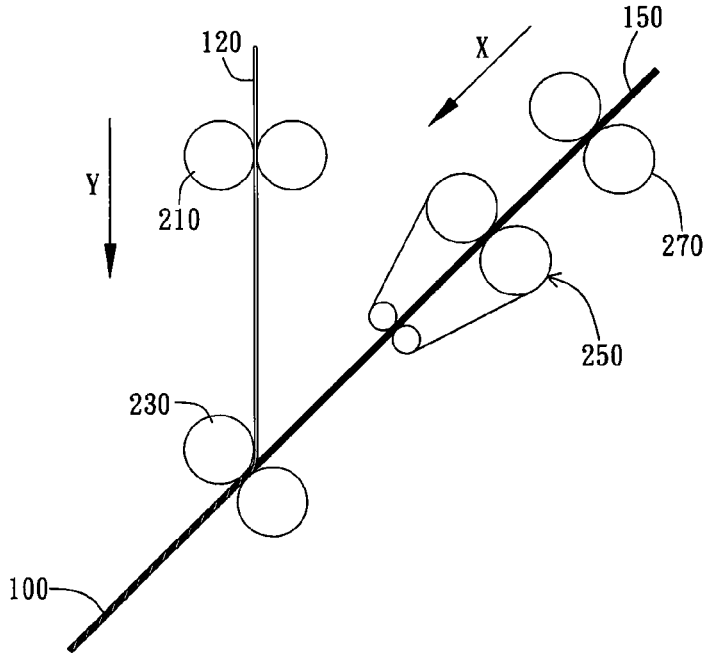
FIG. 1 is a schematic view of one embodiment of the process of manufacturing the ultra-soft yarn.
Figure 2:
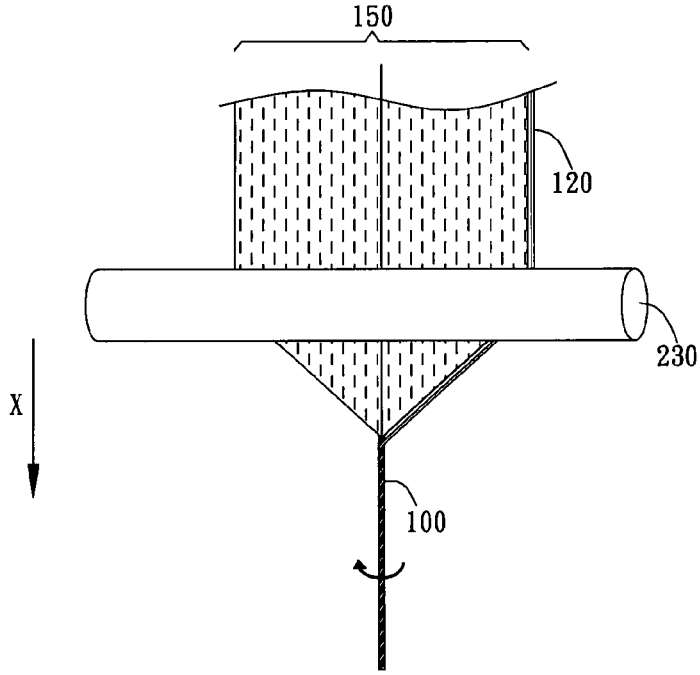
FIG. 2 is a schematic view of another embodiment of the process of manufacturing the ultra-soft yarn.

In the embodiment shown in FIG. 1, the ultra-soft yarn manufacturing method is performed by several components including a pair of yarn guiders 210, a pair of front rollers 230, a pair of drawing aprons 250, and a pair of back rollers 270. As shown in FIG. 1, the roving material 150 is roved along the direction X guided by the drawing aprons 250, while the spun yarn 120 is transported along the direction Y through the yarn guiders 210. As shown in FIG. 2, after the roving material 150 and the spun yarn 120 pass through the front rollers 230, the roving material 150 and the spun yarn 120 are spun together. That is, the roving material 150 is wrapped with the spun yarn 120 by a low twisted multiplier of about 1 to 4. As shown in FIG. 2, the spun yarn 120 spirally wraps the roving material 150 to form the ultra-soft yarn. A tension controller (not shown) can be provided to the pair of the yarn guiders 210 to maintain appropriate yarn tension for continuously forming the ultra-soft yarn.

In the embodiment shown in FIG. 1, the roving material 150 and the spun yarn 120 are spun with twist-multiplier (T.M.) of 1 to 4. In this embodiment, the twist-multiplier is preferably 1; however, in other embodiments, the twist-multiplier can be adjusted between 1 and 4 to manufacture the ultra-soft yarn 100. Moreover, the roving material 150 is drawn at a draw ratio. In the embodiment shown in FIG. 1, the drawing apron 250 controls the draw ratio to improve the formation of yarn. In this embodiment, the draw ratio is preferably 1; however, in other embodiments, the draw ratio can range between 1 and 10.

For color collocation, the ultra-soft yarn 100 is preferably dyed after the roving material 150 (core portion) and the spun yarn 120 (wrapping portion) are spun together. However, in another embodiment, the ultra-soft yarn 100 can be dyed before the spun yarn 120 wraps the roving material 150, respectively. In general, yarn in fabric is less shrinkable than individual yarn. However, by forming the micro twisted yarn of the present invention due to the low twist multiplier of about 1 to 4, the ultra-soft yarn is less shrinkable either in fabric form or yarn form. As such, the ultra-soft yarn can be dyed either before or after woven or knitted as fabric to achieve similar color collocation effect without significant shrinkage.

In the embodiment shown in FIG. 1, the preferred yarn count of the spun yarn 120 can be Ne 40 to Ne 300, specifically, Ne 40 to 80, Ne 80 to 100, Ne 100 to 150, Ne 150 to 200, Ne 200 to 250, or Ne 250 to 300. In this embodiment, the spun yarn 120 includes staple fiber of cotton. However, in other embodiments, the staple fiber can be selected from the group consisting of rayon, renewable cellulose fibers, linen, and flax. In another embodiment, the spun yarn 120 can be replaced with filaments 120. The filament can be 10 Denier to 100 Denier, specifically, 10 D to 30 D, 30 D to 50 D, 50 D to 80 D, or 80 D to 100 D. In this embodiment, the filament 120 can be selected from the group consisting of polyester, polyethylene terephthalate, polyamide (nylon, polyamide 6, polyamide 66), polypropylene, polyacrylonitrile, and Lyocell. Moreover, in the embodiments shown in FIG. 1 and FIG. 2, the spun yarn 120 is spirally twisted on the roving material 150. In this case, the roving material 150 preferably includes staple fiber of cotton; however, in other embodiments, the roving material 150 can include staple fiber selected from the group consisting of rayon, acetate, triacetate, wool, silk, linen, flax, polyester, polyamide, polyacrylonitrile, polypropylene, aromatic polyamide, renewable cellulose fiber, and other nature or artificial staple fibers. Besides, the yarn count of the roving material can be Ne 5 to Ne 50, specifically Ne 5 to Ne 10, Ne 10 to 15, Ne 15 to Ne 20, Ne 20 to Ne 30, Ne 30 to Ne 40, Ne 40 to Ne 45, or Ne 45 to Ne 50. The ultra-soft yarn 100 has a fluff length ranging from 1 mm to 15 mm, specifically in a range of, for example, 1 mm to 5 mm, 5 mm to 8 mm, 8 mm to 12 mm, or 12 mm to 15 mm.

Moreover, the present invention provides at least one yarn carrier for dyeing the spun yarn 120, the roving material 150, or the micro twisted yarn at a temperature of 60° C. to 130° C., specifically, for instance, 60° C. to 70° C., 70° C. to 90° C., 90° C. to 100° C., 100° C. to 110° C., 110° C. to 125° C., or 125° C. to 130° C. The dyes can be selected from reactive dyes, acidic dyes, alkali dyes, dispersible dyes, and indigosol dyes. In the present invention, the twist per inch (TPI) of the ultra-soft yarn 100 is given as the equation: TPI=twist-multiplier($\alpha$)$\times\sqrt{Ne}$(yarn count). Therefore, the actual TPI will change depending on the yarn count and the twist-multiplier.

In addition, the present invention also provides a fabric made of the ultra-soft yarns 100 described in the above-mentioned embodiments. The fabric can be woven or knitted as woven fabric or knit fabric, respectively. In this embodiment, the woven fabric includes Oxford, Creep, and Denim; in other embodiments, the knitted fabric includes Jersey, Pique, Rib, Interlock, Jacquard, and Eyelet. Furthermore, the fabric of the present invention contain 1% to 100% of the ultra-soft yarn of the present invention, the percentage of the ultra-soft yarn can be modified based on the fabric property.

Referring particularly to the following examples for the purpose of practice only and not limitation, there is illustrated:

Two examples of the micro twisted yarn are described below. In the first example, the roving material 150 is cotton and its yarn count is Ne 10. In this case, the material of the spun yarn 120 is cotton and its yarn count is Ne 50. In the second example, the roving material 150 is cotton and its yarn count is Ne 20. In this case the material of the spun yarn is cotton and its yarn count is 80. The ultra-soft yarns formed by wrapping the roving material 150 with the spun yarn 120 in the first and second examples both have a twist multiplier($\alpha$) 1 to 3. Therefore, if $\alpha$=1, TPI of the first example is 7.07, while TPI of the second example is 8.94. The larger TPI the sample has, the more twisted structure the sample will have.

Two examples of the woven fabric are described. In the first example, the warp of the fabric is general cotton yarn (Ne 40) and the weft of the fabric is the above-mentioned ultra-soft yarn (Ne 20). The warp and the weft are woven as a kind of woven fabric having a warp density 100 (number/inch) and a weft density 48 (number/inch). In the second example, the warp is general cotton yarn (Ne 40) and the weft is the above-mentioned ultra-soft yarn (Ne 10). The warp and the weft are woven as a kind of woven fabric having a warp density 100 (number/inch) and a weft density 48 (number/inch). Both of the examples provide the fabric having ultra softness, draping property, and better hand feel.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A process for manufacturing an ultra-soft yarn comprising wrapping a roving material with a yarn by a twist-multiplier of about 1.5 to 4, wherein the roving material is drawn at a draw ratio between 1 and 10.

2. The process for manufacturing an ultra-soft yarn of claim 1, wherein the yarn includes a spun yarn having a yarn count (Ne) of 40~300.

3. The process for manufacturing an ultra-soft yarn of claim 2, wherein the spun yarn includes staple fiber selected from the group consisting of cotton, rayon, renewable cellulose fiber, linen, and flax.

4. The process for manufacturing an ultra-soft yarn of claim 1, wherein the yarn includes a filament of 100 Denier~10 Denier.

5. The process for manufacturing an ultra-soft yarn of claim 4, wherein the filament is selected from the group consisting of polyester (PET), polyethylene terephthalate (PET), polyamide (nylon, polyamide 6, polyamide 66), polypropylene, polyacrylonitrile, and Lyocell.

6. The process for manufacturing an ultra-soft yarn of claim 1, wherein the yarn is spirally twisted on the roving material.

7. The process for manufacturing an ultra-soft yarn of claim 1, wherein the roving material includes staple fiber selected from the group consisting of cotton, rayon, acetate, triacetate, wool, silk, linen, flax, polyester, polyamide, polyacrylonitrile, polypropylene, aromatic polyamide, renewable cellulose fiber, and other nature or artificial staple fiber.

8. The process for manufacturing an ultra-soft yarn of claim 1, wherein the ultra-soft yarn has a fluff length between 1 mm and 15 mm.

9. The process for manufacturing an ultra-soft yarn of claim 1, wherein the ultra-soft yarn is dyed in a yarn carrier at a temperature of 60° C.~130° C.

10. A fabric, comprising:

a roving material drawn at a draw ratio between 1 and 10; and a yarn wrapping the roving material by a twist-multiplier larger than 1.5 and less than or equal to 4.

11. The fabric of claim 10, wherein the yarn includes a spun yarn having a yarn count (Ne) of 40~300.

12. The fabric of claim 11, wherein the spun yarn includes staple fiber selected from the group consisting of cotton, rayon, renewable cellulose fibers, linen and flax.

13. The fabric of claim 10, wherein the yarn includes a filament of 100 Denier~10 Denier.

14. The fabric of claim 13, wherein the filament is selected from the group consisting of polyester, polyethylene terephthalate, polyamide (nylon, polyamide 6, polyamide 66), polypropylene, polyacrylonitrile, and Lyocell.

15. The fabric of claim 10, wherein yarn is spirally twisted on the roving material.

16. The fabric of claim 10, wherein the roving material includes staple fiber selected from the group consisting of cotton, rayon, acetate, triacetate, wool, silk, linen, flax, polyester, polyamide, polyacrylonitrile, polypropylene, aromatic polyamide, renewable cellulose fiber and other nature or artificial staple fiber.

17. The fabric of claim 10, wherein the ultra-soft yarn has a fluff length between 1 mm and 15 mm.

18. The fabric of claim 10, wherein the ultra-soft yarn is dyed in a yarn carrier at a temperature of 60° C.~130° C.

19. The fabric of claim 10, wherein the fabric contains 1% to 100% of the ultra-soft yarn.

* * * * *